US008820281B2

(12) United States Patent
Dietel et al.

(10) Patent No.: US 8,820,281 B2
(45) Date of Patent: Sep. 2, 2014

(54) CAMSHAFT WITH VARIABLE VALVE OPENING PERIOD

(75) Inventors: Uwe Dietel, Reinsdorf OT Vielau (DE); Uwe Grossgebauer, Dresden (DE); Jurgen Meusel, Dittmansdorf (DE); Bernd Mann, Zschopau (DE)

(73) Assignee: Thyssenkrupp Presta Teccenter AG (LI)

( * ) Notice: Subject to any disclaimer, the term of this patent is extended or adjusted under 35 U.S.C. 154(b) by 73 days.

(21) Appl. No.: 13/496,640

(22) PCT Filed: Aug. 24, 2010

(86) PCT No.: PCT/EP2010/005181

§ 371 (c)(1), (2), (4) Date: May 30, 2012

(87) PCT Pub. No.: WO2011/032632

PCT Pub. Date: Mar. 24, 2011

(65) Prior Publication Data

US 2012/0260873 A1 Oct. 18, 2012

(30) Foreign Application Priority Data

Sep. 16, 2009 (DE) ..... 10 2009 041 426

(51) Int. Cl.

| | |
|---|---|
| ***F01L 1/34*** | (2006.01) |
| ***F01L 13/00*** | (2006.01) |
| ***F01L 1/08*** | (2006.01) |
| ***F01L 1/344*** | (2006.01) |
| *F01L 1/047* | (2006.01) |

(52) U.S. Cl.

CPC ..... *F01L 13/0057* (2013.01); *F01L 2001/0473* (2013.01); *F01L 13/0047* (2013.01); *F01L 1/08* (2013.01); *F01L 13/0036* (2013.01); *F01L 1/34413* (2013.01); *F01L 2013/0089* (2013.01)

USPC ..... 123/90.16; 123/90.6

(58) Field of Classification Search

USPC ..... 123/90.6, 90.16

See application file for complete search history.

(56) References Cited

U.S. PATENT DOCUMENTS

| | | | | |
|---|---|---|---|---|
| 4,332,222 | A | 6/1982 | Papez | |
| 4,771,742 | A | 9/1988 | Nelson et al. | |
| 4,788,946 | A * | 12/1988 | Inoue et al. | 123/90.16 |

(Continued)

FOREIGN PATENT DOCUMENTS

| | | |
|---|---|---|
| DE | 2921645 | 12/1980 |
| DE | 2822147 | 2/1982 |

(Continued)

OTHER PUBLICATIONS

International Search Report for PCT/EP2010/005181, English translation attached to original, Both Completed by the European Patent Office on Jan. 28, 2011, All together 7 Pages.

*Primary Examiner* — Zelalem Eshete

(74) *Attorney, Agent, or Firm* — Brooks Kushman P.C.

(57) ABSTRACT

A camshaft for an internal combustion engine, having a hollow outer shaft and an inner shaft which is concentrically mounted inside the outer shaft to be rotatable about an angle and a multi-part cam element having a first cam section that is mounted on the outer shaft in a rotationally fixed manner and a second cam section that is connected to the inner shaft in a rotationally fixed manner and rotationally mounted on the outer shaft. The two cam sections have different cam contours, the relative movement of the two cam sections in opposite directions allowing the resulting cam contour of the cam element interacting with a cam follower to be changed to adjust the variable valve opening period. The two cam sections have different maximum lifts, the cam top section of the cam section having the smaller maximum lift being substantially formed by an annular sector.

10 Claims, 4 Drawing Sheets

(56) References Cited

U.S. PATENT DOCUMENTS

Figure 1A:
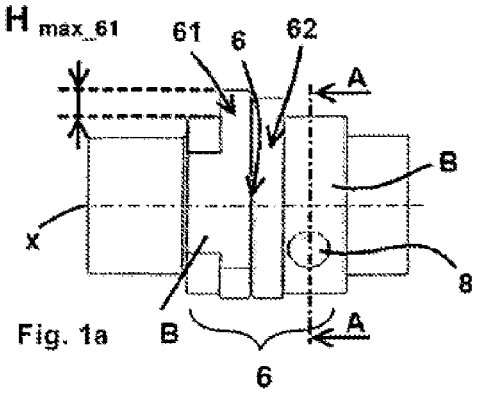

| | | | | |
|---|---|---|---|---|
| 5,165,303 | A * | 11/1992 | Riemscheid et al. | 74/567 |
| 7,069,892 | B2 | 7/2006 | Lechner et al. | |
| 7,306,202 | B2 | 12/2007 | Udd | |
| 7,431,002 | B2 | 10/2008 | Hoffmann et al. | |
| 7,597,078 | B2 | 10/2009 | Kroos et al. | |
| 8,210,143 | B2 | 7/2012 | Meusel et al. | |

FOREIGN PATENT DOCUMENTS

| | | |
|---|---|---|
| DE | 3933923 | 4/1991 |
| DE | 4122251 | 1/1992 |
| DE | 4306621 | 9/1994 |
| DE | 19638331 | 4/1997 |
| DE | 19646934 | 5/1998 |
| DE | 19757504 | 7/1999 |
| DE | 10256592 | 6/2004 |
| DE | 102004056191 | 6/2006 |
| DE | 102005004976 | 8/2006 |
| DE | 102005062208 | 6/2007 |
| EP | 1362986 | 11/2003 |
| EP | 1500797 | 1/2005 |
| EP | 1696107 | 8/2006 |
| GB | 2424257 | 9/2006 |
| WO | 2004005677 | 1/2004 |

* cited by examiner

CAMSHAFT WITH VARIABLE VALVE OPENING PERIOD

CROSS-REFERENCE TO RELATED APPLICATION

This application is the U.S. national phase of PCT Appln. No. PCT/EP2010/005181 filed Aug. 24, 2010, which claims priority to German application DE10 2009 041 426.6 filed on Sep 16, 2009, the disclosures of which are incorporated in their entirety by reference herein.

The invention relates to a camshaft for an internal combustion engine in accordance with the preamble of claim 1.

In order for it to be possible to operate an internal combustion engine under different operating conditions in as optimum a manner as possible, a very wide variety of methods are already known from the prior art. For instance, the variation of the valve opening period by changing the active cam contour has already been described multiple times in the prior art. U.S. Pat. No. 4,771,742 A1 has already disclosed a camshaft having a hollow outer shaft and an inner shaft which is arranged concentrically within the outer shaft such that it can be rotated, a first part cam of a cam element being connected fixedly on the outer shaft so as to rotate with it and a second part cam of the cam element being connected fixedly to the inner shaft so as to rotate with it and being mounted rotatably on the outer shaft. The cam contour of the cam element and therefore the valve opening time can be varied accordingly by rotation of the two cam elements with respect to one another, via a rotation of the inner and outer shafts with respect to one another. If the part cams of substantially identical formation are then rotated with respect to one another, the valve opening time can be extended correspondingly. It is disadvantageous here that the maximum rotation angle can turn out to be only very low, since otherwise the kinematic discontinuity which occurs upon rotation of the camshaft becomes too great.

In order to avoid the abovementioned problem, EP 1 500 797 A1 has already disclosed a camshaft, in which adjacent part cams can likewise be rotated with respect to one another (in order to vary the valve opening period) via the inner and outer shafts which are mounted rotatably with respect to one another. The two part cams of a cam element which can be rotated with respect to one another are flattened here in the manner of a plateau in their cam peak section which forms the cam contour, so that comparatively wide spreading of the two part cams with respect to one another is possible as a result. A disadvantage of said embodiment is the associated reduced valve lift, in order to reliably rule out piston/valve contact.

It is an object of the present invention to provide a camshaft of the generic type for an internal combustion engine, in which camshaft as great an adjustment angle as possible of the part cams is ensured with retention of as great a cam lift as possible. In particular, kinematic and dynamic discontinuities in the valve lift, valve speed and valve acceleration profile are to be reduced as far as possible or avoided by the invention.

According to the invention, this object is achieved by the entirety of the features of claim 1. The camshaft according to the invention is distinguished by the fact that the two part cams of a cam element which can be rotated with respect to one another have a different maximum lift height, the cam peak section (corresponding to the cam contour which extends beyond the base circle of the (part) cam) of the part cam having the lower maximum lift height has a cam contour section of maximum lift height, which cam contour section is formed by a circular arc section. Here, in the context of the invention, embodiments are also included, in which the circular arc section is reduced or increased slightly over its course, over the course of the cam contour section of maximum lift height (that is to say, contour sections which differ from the circular form with a constant diameter within a predefined tolerance range—in particular differing by up to +/−5% of the base circle diameter of the circular arc section).

In one particularly preferred embodiment of the invention, the circular arc section is a constituent part of a circle which is arranged concentrically with respect to the rotational axis of the camshaft. Advantageously, the cam peak section of the part cam having the greater maximum lift height is configured in its active flank region (corresponding to the flank region of maximum lift height which interacts with a cam follower) in such a way that a consistently extending transition (or a transition which ensures consistent kinematics) is formed at the transfer point, at which a change of the active cam contour from one part cam to the other part cam takes place. This is achieved, in particular, by the fact that the active cam contour section opens substantially rectilinearly into the transfer point, in particular in such a way that an extension of this rectilinear section forms a tangent on the circular arc section of the part cam having the smaller maximum lift height. Kinematic discontinuities can be avoided reliably in this way.

In order to avoid tilting moments between the multiple piece cam element and a cam follower which interacts with the cam element, the cam element can comprise at least three individual part cams, two of the three part cams having an identical cam contour.

Overall, the configuration according to the invention of a camshaft can realize the variation of the valve opening time by the displacement of a part region of at least one flank (opening and/or closing flank) of the cam contour of a cam element which consists of two or more part cams, the part cams having different cam contours and only one of the part cams forming the global maximum of the cam element.

Figure 2A:
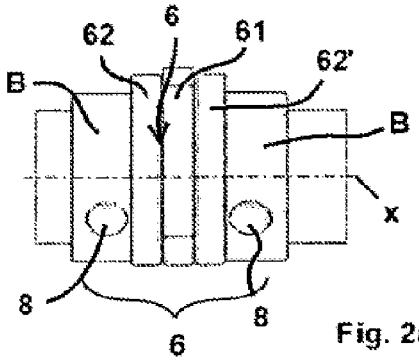
Figure 1B:
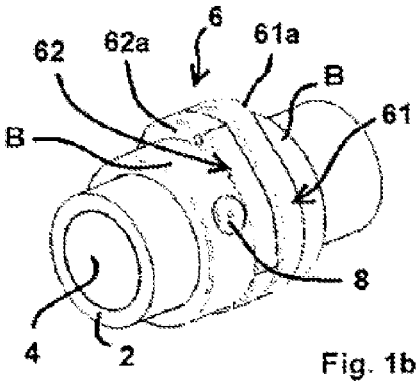
Figure 2B:
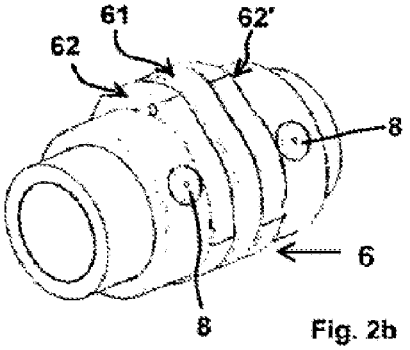
Figure 1C:
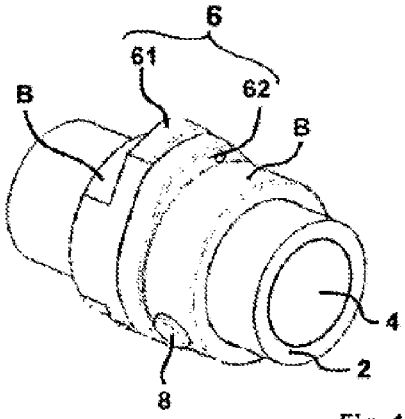
Figure 2C:
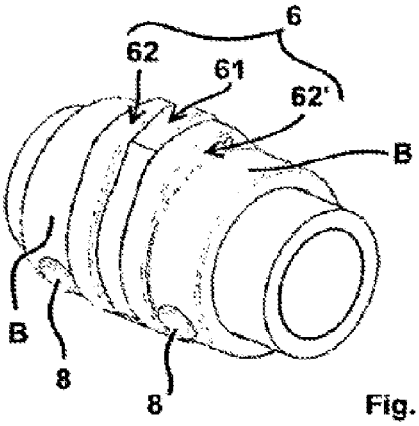
Figure 3:
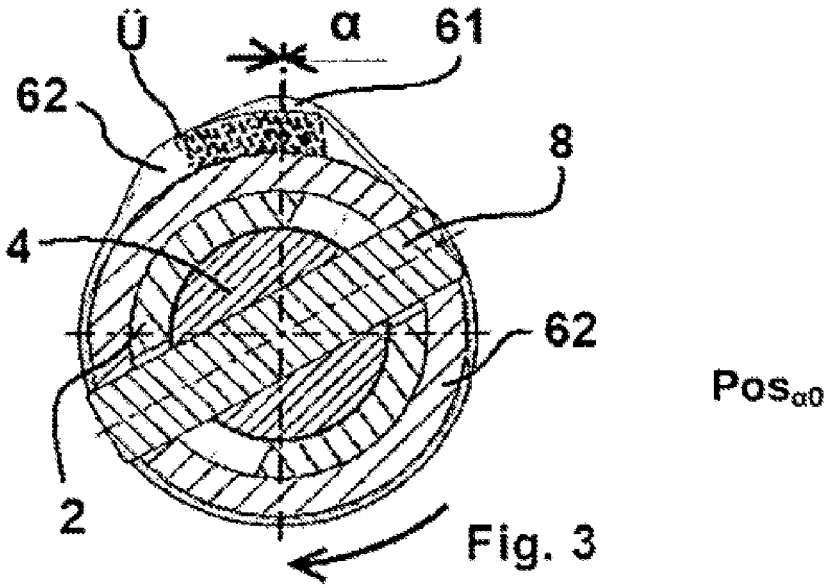
Figure 4:
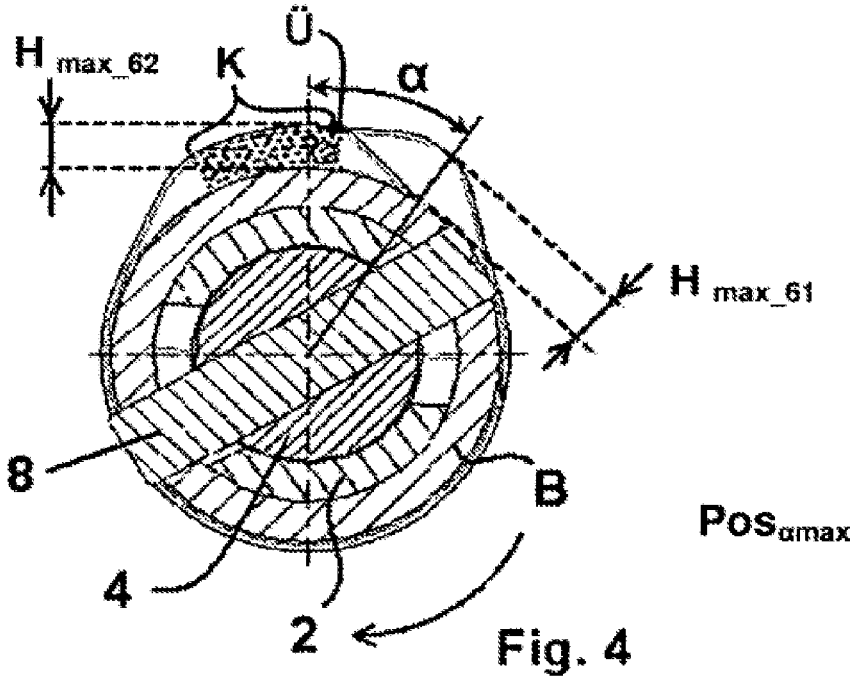
Figure 5:
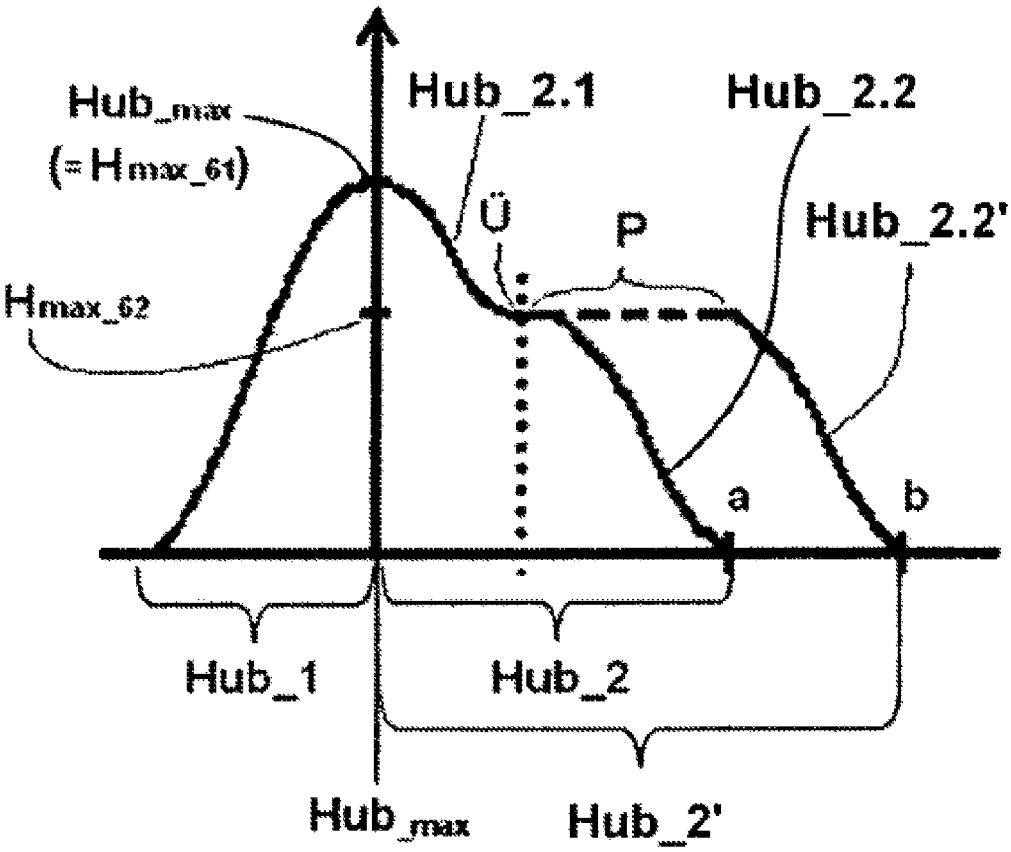
Figure 7:
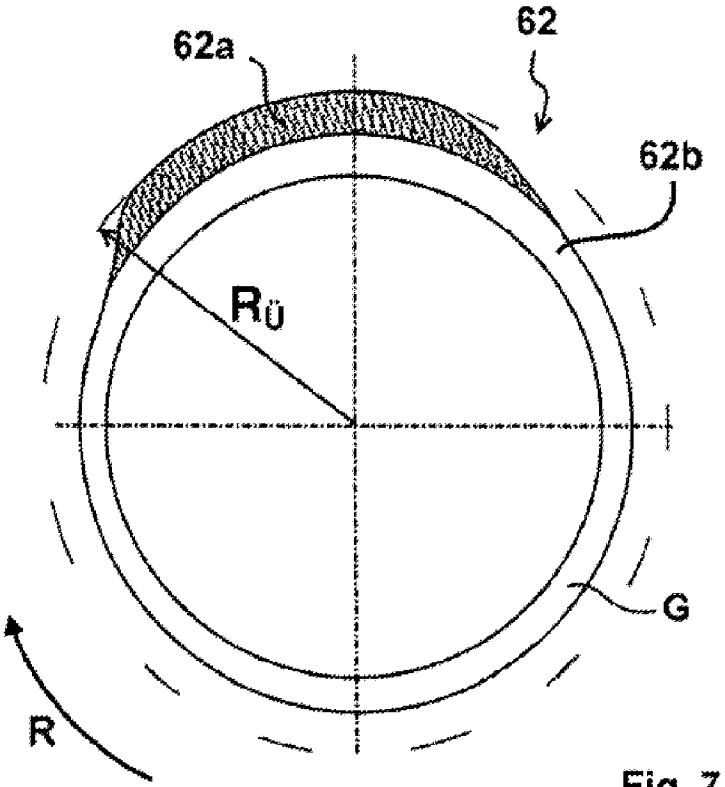
Figure 6:
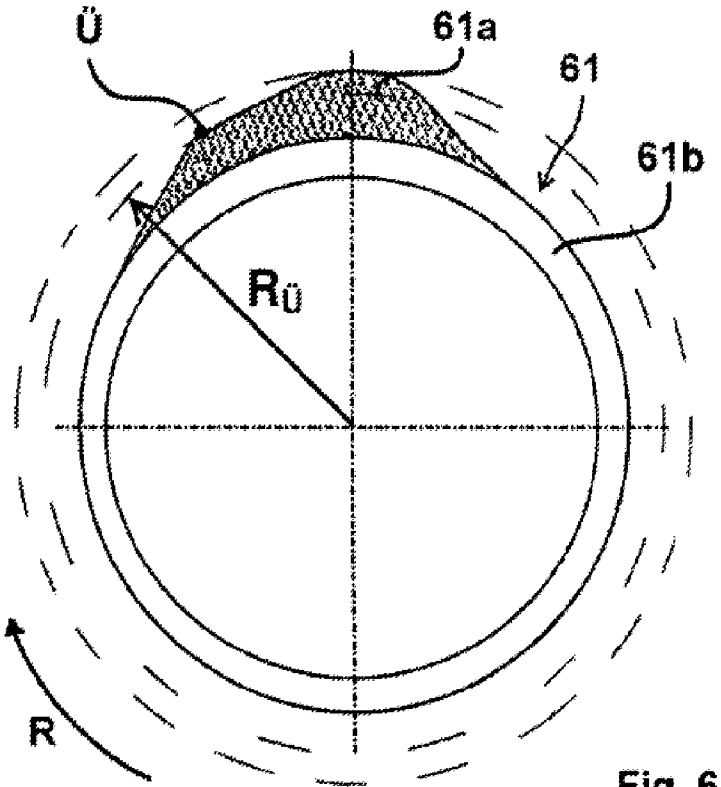

In the following text, the invention will be explained in greater detail using exemplary embodiments which are shown in the figures of the drawing, in which:

FIG. 1*a* shows a detail of the camshaft according to the invention having two part cams which can be rotated with respect to one another, in a plan view, FIGS. 1*b*, 1*c* show the camshaft shown as a detail according to FIG. 1*a* in different perspective illustrations, FIG. 2*a* shows a further possible embodiment of the camshaft according to the invention in a detail view which is analogous to FIG. 1*a*, FIGS. 2*b*, 2*c* show the camshaft shown as a detail according to FIG. 2*a* in different perspective illustrations, analogously to FIGS. 1*b* and 1*c*, FIG. 3 shows the camshaft according to the invention according to FIGS. 1*a* to 1*c* in a cross section along the sectional line A-A in FIG. 1*a*, at an adjustment angle $\alpha=0°$, FIG. 4 shows the camshaft as viewed in cross section analogously to FIG. 3, with part cams which are rotated with respect to one another by the adjustment angle $\alpha=\alpha_{max}$, FIG. 5 shows the valve lift profile of the camshaft according to the invention in a coordinate system, plotted against its rotational angle or its phase position, FIG. 6 shows the part cam having the greater maximum lift height in a side view, and FIG. 7 shows the part cam having the smaller maximum lift height in a side view.

FIGS. 1*a* to 1*c* show details of the camshaft according to the invention for an internal combustion engine in different illustrations. According to FIG. 1*a*, the camshaft is shown in a plan view transversely with respect to the rotational axis X of the camshaft. The camshaft according to the invention comprises a hollow outer shaft 2 and an inner shaft 4 which is arranged such that it is mounted concentrically within the outer shaft 2 and can be rotated by a rotational angle α (FIG. 1*b*, FIG. 1*c*). In the exemplary embodiment shown, the camshaft carries a cam element 6 which consists of two part cams 61, 62 which can be rotated with respect to one another. Here, the first part cam 61 is arranged fixedly against rotation and displacement on the outer shaft 2, whereas the second part cam 62 is connected fixedly to the inner shaft 4 so as to rotate with it and is arranged rotatably on the outer shaft 2. Here, the arrangement of the first part cam 61 such that it is fixed against rotation and displacement can be realized via conventional methods by means of a non-positive or a frictionally locking connection. In the exemplary embodiment shown, the second part cam 62 is via a pin connection by means of a connecting pin 8 which is guided by a slot-shaped recess in the hollow outer shaft 2, which recess extends transversely with respect to the camshaft rotational axis X, and is connected fixedly to the inner shaft 4 in a non-positive or frictionally locking manner so as to rotate with it.

In its cam peak section 61*a*, the first part cam 61 has a cam contour which is different than the cam contour of the cam peak section 62*a* of the second part cam 62, the first part cam 61 having a greater maximum lift height $H_{max_61}$ than the second part cam 62 (see also FIG. 6, FIG. 7). The second part cam 62 has a cam peak section 62*a* which, over a predefined angular range, has a circularly arcuate cam contour section K (also called circular arc section K) with a substantially constant radius (Rü) with respect to the camshaft rotational axis X. Here, the cam contour section is advantageously configured as a circular arc section K of a circle which is arranged concentrically with respect to the rotational axis X of the camshaft. FIG. 1*b* shows the camshaft in a perspective illustration, the front part cam being configured as the part cam 62 having the smaller maximum lift height $H_{max_62}$ and the part cam 61 which lies behind it being formed by the part cam having the greater maximum lift height $H_{max_61}$. Finally, FIG. 1*c* shows the camshaft according to the invention according to FIG. 1*a* and FIG. 1*b* in a further perspective illustration.

In the exemplary embodiment shown, the camshaft which is adjustable with regard to a cam spread with its hollow outer shaft 2 and the inner shaft 4 which is arranged concentrically within the outer shaft 2 such that it can be rotated and adjusted (or spread) over a rotational angle of 30° angular degrees and more on account of the configuration according to the invention, without kinematic discontinuities occurring during operation. Here, the two part cams 61, 62 are arranged directly next to one another axially with respect to the camshaft and form the cam contour (resulting cam contour of the cam element 6) which is required to actuate a valve and interacts with a corresponding cam follower (not shown). Here, the (resulting) cam contour has one flank for opening and one flank for closing the valve. The method of operation in this regard of the camshaft according to the invention will be explained in greater detail later using FIGS. 3 and 4.

Since the two part cams 61, 62 are to be configured and kept as narrow as possible for space or weight reasons, and this can produce problems during the fastening on the camshaft, the two part cams 61, 62 are in each case widened in the axial direction via a collar B of circularly cylindrical configuration as viewed in cross section. The position and width of the cam follower (drag lever, rocker arm or the like; not shown) which interacts with the cam element 6 or with the part cams 61, 62 have to be selected in such a way that it can follow the profile of the part cams 61, 62. For the case which is shown in FIGS. 1*a*-1*c*, corresponding tilting moments act on the cam follower on account of the asymmetrical design of the cam element 6. In order to avoid tilting of the cam follower, the cam element 6 can also comprise a total of three or more individual part cams. FIGS. 2*a*-2*c* show an embodiment of this type with a total of three part cams 61, 62, 62'.

FIG. 3 shows the camshaft according to the invention in a cross section along the sectional line A-A from FIG. 1. The illustration shows the camshaft in an operating position ($Pos_{\alpha 0}$) of the outer shaft 2 and inner shaft 4 in which they are not rotated with respect to one another (α=0°). The two part cams 61 and 62 are shown individually in an individual view in FIGS. 6 and 7, respectively. Here, each part cam 61, 62 consists of a cam base circle segment 61*b*, 62*b* of circularly annular configuration as viewed in cross section and in each case one cam peak section 61*a* and 62*a* which is arranged thereon and widens the base circle section radially. Here, the cam peak sections 61*a* and 62*a* form the active cam contour of the part cams 61 and 62, respectively, with regard to valve opening. In the exemplary embodiment shown, the first part cam 61 is configured as the part cam having the greater maximum lift height $H_{max_61}$ and the second part cam 62 is configured as the part cam having the lower maximum lift height $H_{max_62}$. A camshaft rotational direction in the clockwise direction being understood (FIG. 3), the first part cam 61 has a substantially conventional cam profile (of a non-spreadable standard cam) in the first half (up to its maximum lift) of its cam peak section 61*a* (opening flank), whereas the cam profile is preferably configured in the rear cam peak section in such a way that there is an, in particular, substantially rectilinearly extending (flatly falling) cam contour at least in regions, the imaginary rectilinear extension of which cam contour forms a tangent to an imaginary circle with the radius Rü of that circular arc section K of the second part cam 62 which forms the maximum lift height $H_{max_62}$ at the transfer point Ü, at which a change of the active cam contour from one part cam 61 to the other part cam 62 takes place. In one particularly preferred embodiment of the invention, the two cam peak sections 61*a*, 62*a* of the two part cams 61, 62 are configured in such a way that (in the mounted state on the camshaft) they overlap or are superimposed in their cam peak sections 61*a*, 62*a* in a transfer or transition region, in such a way that the cam follower which interacts with the cam element 6 interacts in this transition region with the cam contours of both part cams 61, 62 before a transition to the second part cam 62 takes place. For this purpose, said transition region for the first part cam 61 is configured analogously to the circular arc section K of the second part cam 62. In terms of manufacturing technology, the two part cams 61, 62 can be machined (for example, ground) jointly in the completely (maximum) spread state in order to produce the circular arc section K. In the non-rotated operating position ($Pos_{\alpha 0}$) which is shown according to FIG. 3, the two part cams 61, 62 are arranged with respect to one another in such a way that, in the region of its active cam contour, the second part cam 62 having the lower maximum lift height $H_{max_62}$ withdraws at least in regions behind the part cam 61 having the greater maximum lift height $H_{max\ 61}$ and is thus not in engagement (during the operation of the camshaft with α=0°) in this cam contour region with a cam follower which follows the (resulting) cam contour. In the case of a rotation of the camshaft with part cams 61, 62 which are not rotated with respect to one another (α=0), the second part cam 62 having the lower maximum lift height $H_{max_62}$ would only come into contact by way of its cam peak section 62*a* with the cam follower at the end of the circular arc section K (see also following description of a possible following sequence). As soon as a relative movement between the inner shaft 4 and the outer shaft 2 and therefore a rotation of the part cams 61 and 62 with respect to one another take place ($\alpha>0$), that cam contour section of the cam peak section 62*a* which is formed by the circular arc section K comes into engagement with the cam follower. It is essential to the invention that the cam contour of the part cams 61 and 62 is configured in such a way that, both in the non-rotated operating position and in every possible rotated operating position ($0°<\alpha\leq\alpha_{max}$), a steady transition (or a transition without substantial kinematic discontinuities from the first part cam 61 to the second part cam 62 in the cam contour of the cam element 6 is formed at the transfer point Ü, as can be seen in FIG. 4.

In FIG. 5, the method of operation of the camshaft which is configured according to the invention is illustrated using a diagram, the valve lift of a valve to be opened being plotted against the phase position of the rotating camshaft in a coordinate system. That cam contour (cam peak section 61*a*, 62*a*) of the cam element 6 (part cams 61 and 62) which is active for the opening of the valve comprises an opening lift region Hub_1 which is brought about by an opening flank of the cam element 6, the point of the maximum opening lift Hub_max, and an opening lift region Hub_2, Hub_2' which is brought about by the closing flank of the cam element 6. Here, the opening opening lift region Hub_1 is formed by the substantially conventionally configured opening flank of the cam section 61*a* of the first part cam 61 having the greater maximum lift height $H_{max_61}$ (including the point of the maximum lift height Hub_max=$H_{max_61}$) whereas the closing opening lift region Hub_2 (as a function of the set rotational angle $\alpha$) is realized by the contour geometry configured according to the invention of the first and second part cam 61, 62. The closing opening lift section Hub_2 is composed of a non-variable lift section part Hub_2.1 (closing flank of the cam section 61*a* of the first part cam 61) and a variable opening lift section Hub_2.2, Hub_2.2', the line section (Hub_2.2) which intersects the abscissa at the intersection point a indicating the opening lift at a rotational angle of $\alpha=0°$, and the line section (Hub_2.2') which intersects the abscissa at the intersection point b indicating the valve lift at a maximum rotational angle of $\alpha=\alpha_{max}$. At the transfer point Ü, the transition of the cam follower from the part cam 61 having the greater maximum lift height $H_{max_61}$ to the part cam 62 having the smaller maximum lift height $H_{max_62}$ takes place. As a result of the design according to the invention, a part region of the closing opening lift region can be displaced in parallel for the purpose of extending the valve opening period. As a result, a planar plateau region P (shown using dashed lines) in the lift profile of the valve opening lift is realized in the closing opening lift region Hub_2. The different intersection points a and b of the valve lift shown with the abscissa show that the adjustment of the part cams 61 and 62 with respect to one another mean a displacement of the closing flank with respect to the outer shaft. In a supplementary manner to FIGS. 3 and 4 and 6 and 7, the following sequence of the part cams with regard to the respectively active cam contour for the exemplary embodiment described will be described in the following text:

In order to obtain the active cam contour, the cam follower follows the part cams 61 and 62, which is described in the following text using FIGS. 3 and 4, for the rotation of the camshaft in the clockwise direction.

In the camshaft according to the invention which is shown in FIG. 3, the rotational angle is $\alpha=0°$, with the result that the part cams 61, 62 are not rotated with respect to one another. On the base circle G of the part cams 61, 62, the cam follower (not shown) is in engagement with both part cams 61, 62. The first half (following the base circle G) of the cam peak section 61*a* (opening flank) is formed solely on the part cam 61, and only the part cam 61 is followed by the cam follower. Even at the maximum lift height $Hub_{max_61}$, that is to say the cam peak, and the adjoining rear cam peak section, the cam follower is in engagement only with the part cam 61. The transfer point Ü is formed on the rear cam peak section, at which transfer point Ü the cam follower moves from the part cam 61 to the part cam 62. At this instant, the cam follower is preferably in engagement with both part cams 61, 62. After the cam follower has moved onto the part cam 62, it follows only the part cam 62 and the closing flank formed on it. In the following base circle G, the cam follower is again in engagement with the part cams 61 and 62.

The part cams 61, 62, 62' according to FIGS. 2*a*-2*c* can also be formed in the base circle G in such a way that the cam follower follows only the part cam 61 or the part cams 62 and 62'.

FIG. 4 shows by way of example a camshaft according to the invention with a set rotational angle $0\leq\alpha\leq\alpha_{max}$. Here too, the cam follower on the base circle G of the part cams is in engagement with both part cams 61, 62. The first half (following the base circle G) of the cam peak section 61*a* (opening flank) is likewise formed solely on the part cam 61, and only the part cam 61 is followed by the cam follower. Even at the maximum lift height $Hub_{max_61}$ that is to say the cam peak, and the adjoining rear cam peak section, the cam follower is in engagement only with the part cam 61. The rear cam peak section has the transfer point Ü, at which the cam follower moves from the part cam 61 to the part cam 62. At this instant, the cam follower is preferably in engagement with both part cams 61, 62. After leaving the transfer point, the cam follower is again only in engagement with the part cam 62. Since the part cams 61 and 62 are rotated to the maximum extent with respect to one another here, the cam follower follows the maximum lift height $Hub_{max_62}$ of the part cam 62 here, which maximum lift height $Hub_{max_62}$ remains substantially identical over the circular arc section K. This region is highlighted by hatching in FIG. 4 for improved comprehension. Even in the case of the closing flank which follows the circular arc section K, the cam follower is in engagement only with the part cam 62. In the following base circle G, both part cams 61, 62 are then followed again by the cam follower.

In order to counteract possibly occurring fluctuations of the adjusting device or tolerance requirements/tolerances of the part cams 61, 62, the base circle G is regularly formed only over a small part region by both part cams 61, 62 (both part cams in engagement with the cam follower).

The invention claimed is:

1. A camshaft for an internal combustion engine, comprising:

a hollow outer shaft and an inner shaft which is arranged concentrically within the outer shaft such that it can be rotated by an angle ($\alpha$), a cam element having first and second part cams rotatable with respect to one another, the first part cam which is arranged fixedly on the outer shaft so as to rotate with it and a second part cam which is connected fixedly to the inner shaft so as to rotate with it and is arranged rotatably on the outer shaft, the first and second part cams acting on the same cam follower, the first and second part cams having a different cam contour as a result of cam peak sections of different configuration, enabling an overall cam contour of the cam element to be varied by relative rotation of the first and second part cams with respect to one another in order to set a variable valve opening period, wherein:

the first and second part cams have a different maximum lift height, the cam peak section of the part cam having the lower maximum lift height has a cam contour section formed by a circular arc section (K), and the cam peak section of the part cam having the greater maximum lift height, at least on the flank side, via which the valve opening period is to be varied, is configured in its flank region in such a way that a consistently extending transition is formed at the transfer point, at which a change of the active cam contour from one part cam to the other part cam takes place.

2. The camshaft as claimed in claim 1, wherein the circular arc section (K) is a constituent part of a circle which is arranged concentrically with respect to the rotational axis of the camshaft.

3. The camshaft as claimed in claim 1, wherein the cam peak sections of the part cams are configured in such a way that they overlap or are superimposed in the case of every set rotational angle (α) in their cam peak sections in a transfer region, in such a way that a cam follower which interacts with the cam element interacts in this transition region with the cam contours of both part cams before a transition to the second part cam takes place.

4. The camshaft as claimed in claim 1, wherein the cam element overall has at least three part cams, two of the part cams having an identical cam contour.

5. The camshaft as claimed in claim 2, wherein the cam peak section of the part cam having the greater maximum lift height , at least on the flank side, via which the valve opening period is to be varied, is configured in its flank region in such a way that a consistently extending transition is formed at the transfer point (ü), at which a change of the active cam contour from one part cam to the other part cam takes place.

6. The camshaft as claimed in claim 2, wherein the cam peak sections of the part cams are configured in such a way that they overlap or are superimposed in the case of every set rotational angle (α) in their cam peak sections in a transfer region, in such a way that a cam follower which interacts with the cam element interacts in this transition region with the cam contours of both part cams before a transition to the second part cam takes place.

7. The camshaft as claimed in claim 2, wherein the cam element overall has at least three part cams, two of the part cams having an identical cam contour.

8. The camshaft as claimed in claim 1, wherein the cam peak sections of the part cams are configured in such a way that they overlap or are superimposed in the case of every set rotational angle (α) in their cam peak sections in a transfer region, in such a way that a cam follower which interacts with the cam element interacts in this transition region with the cam contours of both part cams before a transition to the second part cam takes place.

9. The camshaft as claimed in claim 1 wherein the cam element overall has at least three part cams, two of the part cams having an identical cam contour.

10. The camshaft as claimed in claim 3 wherein the cam element overall has at least three part cams, two of the part cams having an identical cam contour.

* * * * *